US007381295B2

(12) United States Patent
Kokkonen

(10) Patent No.: US 7,381,295 B2
(45) Date of Patent: Jun. 3, 2008

(54) PULP FRACTIONATION USING CENTRIFUGAL CLEANERS AND POWER SCREENS WITH MULTI-LAYER HEADBOX AND DEAERATION TANK

(75) Inventor: Kari Kokkonen, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 582 days.

(21) Appl. No.: 10/380,309

(22) PCT Filed: Sep. 12, 2001

(86) PCT No.: PCT/FI01/00791

§ 371 (c)(1),
(2), (4) Date: Aug. 18, 2003

(87) PCT Pub. No.: WO02/22947

PCT Pub. Date: Mar. 21, 2002

(65) Prior Publication Data

US 2004/0026050 A1 Feb. 12, 2004

(30) Foreign Application Priority Data

Sep. 14, 2000 (FI) ..... 20002031

(51) Int. Cl.
*D21C 9/08* (2006.01)

(52) U.S. Cl. ..... 162/55; 162/123; 162/202; 162/343; 162/380; 96/182; 96/184; 96/186; 96/212

(58) Field of Classification Search ..... 162/55, 162/123, 130, 190, 202, 216, 251, 264, 289, 162/298, 301, 336, 343, 380; 95/243, 182, 95/183, 184, 185, 186, 207, 212, 215
See application file for complete search history.

(56) References Cited

U.S. PATENT DOCUMENTS 3,085,927 A * 4/1963 Pesch ..... 162/55
4,781,793 A * 11/1988 Halme ..... 162/55
5,084,161 A * 1/1992 Vikio ..... 209/2

(Continued)

FOREIGN PATENT DOCUMENTS

DE 195 26 205 A1 1/1997

(Continued)

OTHER PUBLICATIONS

English translation of German patent application DE 195 26 205 A1, Jan. 30, 1997.

(Continued)

*Primary Examiner*—Mark Halpern
(74) *Attorney, Agent, or Firm*—Stiennon & Stiennon

(57) ABSTRACT

Virgin stock is conducted to a paper or board machine and further to a centrifugal cleaner installation (12) into its first centrifugal cleaner step (12$a_1$). From the first centrifugal cleaner step (12$a_1$) the accept is conducted into a multi-layer headbox (10) to form a layer of the web determined according to the concerned fraction. From a second step (12$a_2$) and/or from lower steps (12$a_3$, 12$a_4$ . . . ) of the centrifugal cleaner installation (12) a second fraction or more fractions are conducted into the multi-layer headbox (10) to form a second layer or other layers of the web, which are determined according to the pulp fractionation taking place in the concerned second step or lower steps.

14 Claims, 3 Drawing Sheets

U.S. PATENT DOCUMENTS

| | | | | | |
|---|---|---|---|---|---|
| 5,377,428 | A | | 1/1995 | Clark | |
| 5,567,278 | A | * | 10/1996 | Meinander | 162/190 |
| 5,746,889 | A | | 5/1998 | Huovila et al. | |
| 5,843,281 | A | * | 12/1998 | Huovila | 162/216 |
| 5,916,417 | A | * | 6/1999 | Cassidy et al. | 162/125 |
| 5,958,189 | A | * | 9/1999 | Begemann et al. | 162/264 |
| 6,068,732 | A | * | 5/2000 | Cassidy et al. | 162/123 |
| 6,267,845 | B1 | * | 7/2001 | Hautala et al. | 162/183 |
| 6,413,363 | B1 | * | 7/2002 | Hsu et al. | 162/4 |
| 6,517,685 | B2 | * | 2/2003 | Huovila et al. | 162/258 |
| 6,821,387 | B2 | * | 11/2004 | Hu | 162/129 |

FOREIGN PATENT DOCUMENTS

| | | | | |
|---|---|---|---|---|
| EP | 1 091 040 | A2 | | 4/2001 |
| WO | WO 9964668 | A1 | * | 12/1999 |
| WO | WO 01/29311 | A1 | | 4/2001 |
| WO | WO 02/22947 | A1 | | 3/2002 |

OTHER PUBLICATIONS

Search Report dated Apr. 18, 2001 issued in Finnish Priority Application No. 20002031.

Search Report dated Aug. 10, 2001 issued in Finnish Priority Application No. 20002031.

International Search Report issued in International Patent Application No. PCT/FI01/00791, Apr. 2001.

International Preliminary Examination Report issued in International Patent Application No. PCT/FI01/00791, Aug. 2001.

* cited by examiner

PULP FRACTIONATION USING CENTRIFUGAL CLEANERS AND POWER SCREENS WITH MULTI-LAYER HEADBOX AND DEAERATION TANK

CROSS REFERENCE TO RELATED APPLICATIONS

This application is a U.S. national stage application of International Application No. PCT/FI01/00791, filed Sep. 12, 2001, and claims priority on Finnish Application No. 20002031, filed Sep. 14, 2000, the disclosure of each application is hereby incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention concerns a method and equipment for pulp fractionation in a paper machine or such, such as a board machine.

Multi-layer headboxes are already in use with many board grades and they are also on their way to printing paper machines. Layering has traditionally been done by layering the supply of either filler or retention agents. It is a weakness of this system that the pulp itself is entirely similar in all layers, so the drainability, fibre content and quantities of fines in the layers are not different. This of course limits the efficiency of layering.

Alternatively with e.g. tissue or board machines the different raw material components, such as short and long fibre, are treated separately from each other all the way from pulp treatment to the headbox. In such a system a double pulp system must of course be built all the way from pulp treatment to the paper machine.

Fractionation plants are used also in the production of pulp. Pressurized screens are generally used in the fractionation, and the fractionation is performed already at the pulp plant. In this case too a double pulp system must be built for the paper machine.

SUMMARY OF THE INVENTION

In the system according to the invention, the pulp is brought mixed into the short circulation of the paper machine. For example, in a machine using 100% recycled fibre, there is only one raw material, whereby pulp layering without fractionation cannot be done at all.

The centrifugal cleaners traditionally used in the short circulation of the paper machine have been used only to separate sand. The centrifugal cleaner installation separates pulp e.g. according to its density, size, shape and surface roughness. In the system according to the invention, the fractionation done by centrifugal cleaners is utilised in such a way that the accept of a certain centrifugal cleaner is conducted into a certain bypass manifold of the multi-layer headbox to form a certain web layer. In the system according to the invention, the fractionation ability of centrifugal cleaners is utilised e.g. in such a way that the fraction having more fines or long fibres is guided into the bottom and/or surface layer of the headbox.

In the first step of centrifugal cleaning, the pulp is divided roughly in a suitable proportion between the various layers.

The final fine control of proportioning takes place only at the pump of the headbox. Surplus of pulp is circulated back to the input of the centrifugal cleaner.

Compared with filler layering, the quality of the pulp itself in the various layers can also be varied, and desired fibre fractions can be guided either to the surface or into the middle layer as required.

There is no need for any separate pulp systems before the centrifugal cleaners, but all pulp is brought in only one line all the way to the short circulation.

The equipment already in the short circulation is utilised and there is no need for any new partial processes. Only the operation of step 1 of the centrifugal cleaning is changed in such a way that the so-called reject ratio will correspond with the quantity of fibres needed in the various layers.

According to the invention, the pulp is conducted from the wire pit to the centrifugal cleaner, and from the first stage, that is, from step 1, of the centrifugal cleaner installation the pulp is conducted forward, in one embodiment of the invention into a deaeration tank, the reject of step 1 is conducted further into the second stage of the centrifugal cleaner installation and thence the accept is conducted forward into the second part of the deaeration tank.

An advantageous embodiment of the invention is as follows. The accept arrived from the first stage of centrifugal cleaning into the deaeration tank is conducted from the deaeration tank into the part of the headbox forming the bottom and surface layers of the web, preferably through power screens. The pulp conducted as accept from the second stage, that is, from step 2, of the centrifugal cleaner into the deaeration tank is conducted through a power screen located in between the deaeration tank and the headbox into the bypass manifold of the headbox, through which bypass manifold the pulp is conducted on to the formation wire to form the middle layer of the web.

Thus, in fractionation according to the invention, the centrifugal cleaner installation is utilised and the fractionation is carried out from various stages of the centrifugal cleaner installation in such a way that the pulp conducted from the first stage into the deaeration tank is conducted further after deaeration to form top layers of the web, and the pulp conducted as accept from the second stage or from other stages is moved further from the concerned stage/stages of the centrifugal cleaner installation to form other layers of the web, such as the middle layer of the three-layer web. However, it is not a purpose to limit the invention to the manner of forming a three-layer web described above. With the equipment according to the invention it is also possible to form two-layer paper to paper or board grades having even more layers instead of three-layer paper.

The system thus utilises a centrifugal cleaner installation and its fractionation in the making of multi-layer paper. The system may be applied to such short circulation already in use, which include a centrifugal cleaner. One stock is conducted into short circulation and it is treated in such a way in the centrifugal cleaner installation that the desired fraction can be conducted further through a deaeration tank to the multi-layer headbox into the pulp bypass manifold corresponding with each layer. In the system according to the invention, a power screen may also be used in between the deaeration tank and the headbox in order to achieve the final fractionation result. Such an embodiment is also possible within the scope of the invention, where there is no deaeration from the pulp. In a system where there is no deaeration from the pulp, the accepts of centrifugal cleaning may be taken directly to the suction side of the headbox's feed pump. In other respects the structure of the system is similar to the one in the embodiment shown in FIG. 1.

Such an embodiment may also be possible within the scope of the invention, wherein water leaving the wire section is conducted into the wire pit, from which wire pit the tail water is pumped into the deaeration tank and harmful air is removed from the tail water in the deaeration tank. Then the tail water is admixed with high-consistency pulp, which is conducted further into the centrifugal cleaner installation and further according to the invention from the centrifugal cleaner installation to the multi-layer headbox.

In an embodiment containing a deaeration tank this is preferably in two parts. From the deaeration tank there are discharge fittings for each desired fraction. The pulp fraction can then be branched off to form several layers or conducted without branching in order to form one layer containing the concerned fraction.

BRIEF DESCRIPTION OF THE DRAWINGS

In the following, the invention will be described with reference to the embodiments in the appended figures, but the intention is not to limit the invention to these only.

DESCRIPTION OF THE PREFERRED EMBODIMENTS

Figure 1:
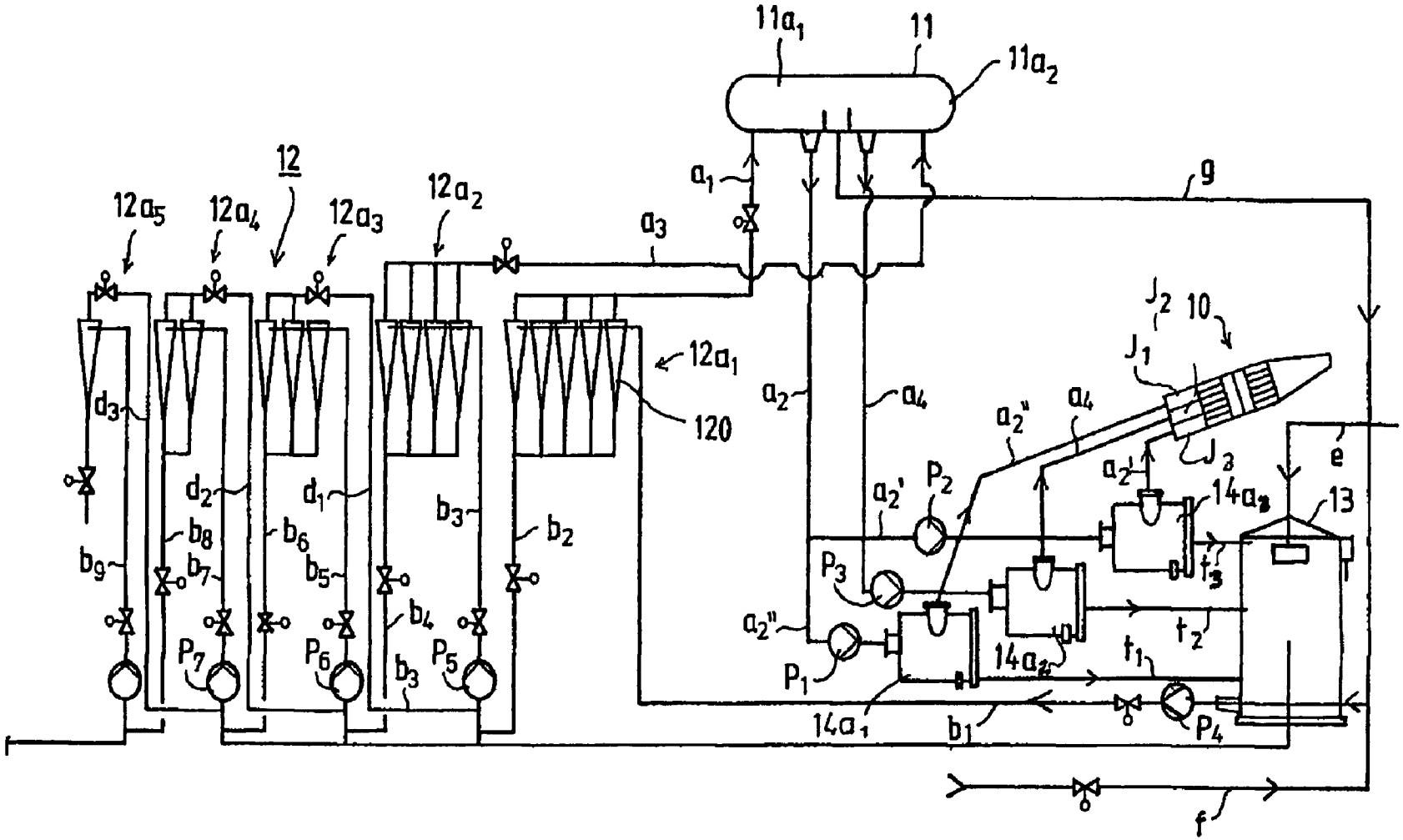
FIG. 1 is a schematic view of the fractionation system according to the invention.

FIG. 1 shows schematically the equipment according to the invention for pulp fractionation. The equipment includes a multi-layer headbox 10 and a deaeration tank 11, which is preferably in many sections, being a two-section tank in this embodiment of the invention. In addition, the system according to the invention includes a centrifugal cleaner installation 12, which includes at least two steps, steps 12$a_1$ and 12$a_2$, that is, centrifugal cleaning degrees. In addition, the system according to the invention includes a wire pit 13 and a fitting $b_1$ leading from this to the first centrifugal cleaning step 12$a_1$ of the centrifugal cleaning installation 12. From the first step 12$a_1$ of the centrifugal cleaning installation 12 there is a further fitting $a_1$ for the accept into the deaeration tank 11, into the first section 11$a_1$ of the said tank. From tank 11$a_1$ there is another fitting $a_2$, which branches off to form fittings $a_2'$ and $a_2''$. The fittings $a_2'$ and $a_2''$ include power screens 14$a_1$ and 14$a_2$, from which the accept is conducted further along fittings $a_2'$ and $a_2''$ to a multi-layer headbox 10 and into its bypass manifolds $J_1$ and $J_3$, from which the pulp is divided further into the headbox's set of pipes, through an intermediate chamber and a turbulence generator to the formation wire (not shown in FIG. 1, see formation wire $H_1$ in FIG. 3) and to form the top and bottom layers of the web. The fittings, such as channels or pipes $a_2'$ and $a_2''$, include pumps $P_2$ and $P_1$ and, correspondingly, a pump $P_3$ is located in a fitting $a_4$. Using the pumps, the pulp fractions are pumped into each bypass manifold $J_1$, $J_2$, $J_3$ of the multi-layer headbox 10.

From the first step 12$a_1$ of the centrifugal cleaner installation 12 there is a fitting $b_2$ by the reject, and further to fitting $b_3$, which leads to the second stage of centrifugal cleaner installation 12, that is, to second step 12$a_2$, from which there is further a fitting $a_3$ for the accept into the second section 11$a_2$ of the deaeration tank 11, and further a fitting $a_4$, e.g. a pipe, into bypass manifold $J_2$ of the multi-layer headbox 10 to form the middle layer of the web. In this application, virgin stock is understood as being the new stock conducted to wire pit 13. The stock includes fillers and additives and fibres. Thus, from the first step 12$a_1$ of the centrifugal cleaner installation 12 there is a fitting $a_1$ into multi-section deaeration tank 11, into its first section 11$a_1$, from which after the deaeration the fraction is transferred further into fitting $a_2$, which branches off to form branch fittings $a_2'$, $a_2''$, which lead further into corresponding pulp bypass manifolds $J_1$ and $J_3$ of the multi-layer headbox 10. Branch fittings $a_2'$, $a_2''$ include power screens 14$a_3$ and 14$a_1$, from which the accept is conducted further to the corresponding bypass manifolds $J_1$, $J_3$ of the headbox, and the reject is conducted along channels $t_1$, $t_3$ back to the wire pit 13. Correspondingly, from the second step 12$a_2$ of the centrifugal cleaner installation 12 the accept is conducted into multi-section deaeration tank 11, into its section 11$a_2$ along fitting $a_3$, and after the deaeration the said fraction is conducted to fitting $a_4$, which is conducted further into the middle bypass manifold $J_2$ of the multi-layer headbox 10 to form the middle layer of the web. Fitting $a_4$ includes a power screen 14$a_2$, from which the accept is conducted into bypass manifold $J_2$ of the multi-layer headbox 10, and the reject is conducted along fitting $t_2$ as a back flow back to wire pit 13.

As is shown in FIG. 1, centrifugal cleaner installation 12 may include several steps. In the embodiment shown in FIG. 1, there are two actual fractionation steps, which are steps 12$a_1$ and 12$a_2$, which are used for forming a three-layer web. Step 12$a_1$ includes centrifugal cleaner cones 120, of which there are five in the step and the accept outlets of which are joined together, while, correspondingly, the reject outlets are joined together. There is a corresponding arrangement in the other steps. The number of cones 120 in step 12$a_2$ is four, in step 12$a_3$ there are three, in step 12$a_4$ two and in the last step 12$a_5$ there is one cone. The reject outlet fitting $b_2$ of step 12$a_1$ is connected to supply channel $b_3$ of the second step 12$a_2$. The reject outlet $b_4$ of step 12$a_2$ is connected to supply fitting $b_5$ of the third step 12$a_3$ and reject outlet $b_6$ of step 12$a_3$ is connected to supply fitting $b_7$ of step 12$a_4$, reject outlet fitting $b_8$ of step 12$a_4$ is connected to supply fitting $b_9$ of the last step 12$a_5$. The accepts of steps 12$a_3$, 12$a_4$ and 12$a_5$, for which there is a fitting $d_1$, $d_2$, $d_3$, are connected in such a way to the system that the accept of step 12$a_3$ is made to flow along fitting $d_1$ to the second step 12$a_2$, into its fitting $b_3$ to the suction side of feed pump $P_5$. Correspondingly, accept fitting $d_2$ of step 12$a_4$ is connected with supply channel $b_5$ of step 12$a_3$ on the suction side of feed pump $P_6$ and, correspondingly, accept fitting $d_3$ of step 12$a_5$ is connected with supply fitting $b_7$ of step 12$a_4$ on the suction side of pump $P_7$. The reject taken from the last step 12$a_5$ is moved entirely to the discharge or to further treatment in connection with another installation.

Fitting $b_1$ from wire pit 13 includes a feed pump $P_4$, and there is an input fitting f for virgin stock to the wire pit. For the tail water of the wire section there is a return fitting e to wire pit 13, and as is shown in the figure, from deaeration tank 11 between the end walls of sections 11$a_1$ and 11$a_2$ there is a return fitting g for overflow to wire pit 13. Negative pressure pump arrangements in connection with deaeration tank 11 for bringing about a negative pressure in the top section of the deaeration tank are not shown. Air is removed from the fractionated pulp with the aid of a high negative pressure brought about in the deaeration tank by a negative pressure pump.

Such an embodiment is also possible within the scope of the invention, where there is no deaeration of the pulp. In systems with no deaeration of the pulp the accept of the centrifugal cleaning may be taken directly to the suction side of the headbox's feed pump. In other respects the system is similar to the one in the embodiment shown in FIG. 1.

Figure 2A:
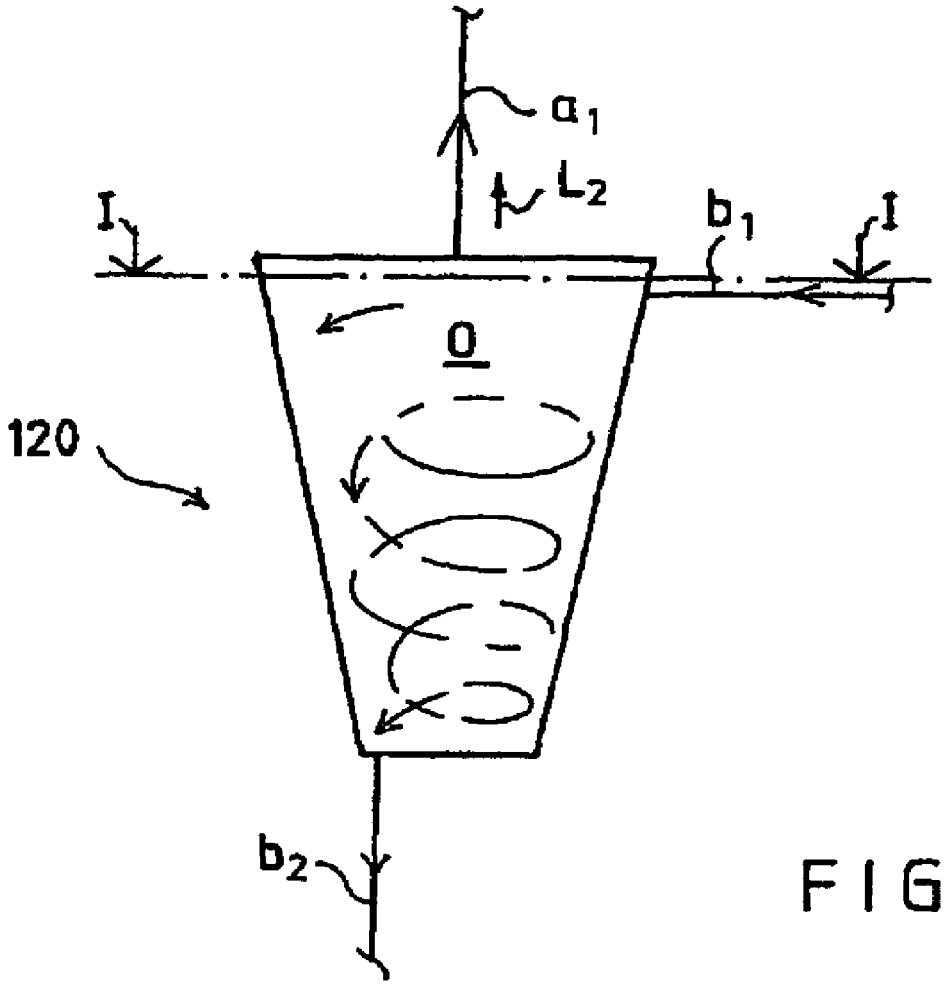
FIG. 2A is a schematic side view of the centrifugal cleaner of the first step of the centrifugal cleaner installation.

FIG. 2A shows one centrifugal cleaner of the first step 12$a_1$ of a centrifugal cleaner installation. There may be several centrifugal cleaner cones 120 in each step 12$a_1$, 12$a_2$ . . . . The accepts of the cones 120 in each step are combined with each other and the rejects are also combined and then conducted along their respective fittings $a_1$, $b_2$; $a_2$, $b_4$ . . . . As is shown schematically in the figure, the heaviest particles move along a helical path downwards in the centrifugal cleaner cone 120 and further out of the cone 120, and from the middle at the top the accepts are conducted forward into the deaeration tank and further into that bypass manifold of the multi-layer headbox, which relates to the concerned fraction. Thus, the fractionation of the centrifugal cleaner is characterised in that fractionation takes place in the said cleaner especially as regards the pulp, whereby the heavier particles move along a helical path to the following step or stage of the centrifugal cleaning, and thus the fractionation takes place also in regard to fillers and additives and not only in regard to fibres.

Figure 2B:
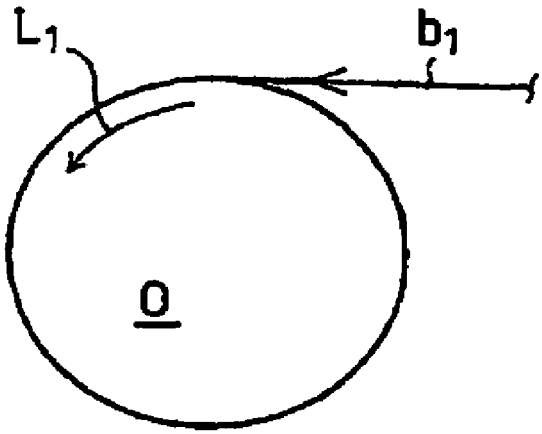
FIG. 2B is a sectional view along line I-I in FIG. 2A.

FIG. 2B is a sectional view along line I-I of FIG. 2A. Fitting $b_1$ is joined tangentially to cone 120. The centrifugal force thus separates the heavier particles from the pulp flow $L_1$ in the space 0 shaped like a truncated cone inside cone 120, while the lighter particles and the pulp fraction separated from the other pulp are conducted (arrow $L_2$) into deaeration tank 11 of the deaeration equipment by way of fitting $a_1$.

Figure 3:
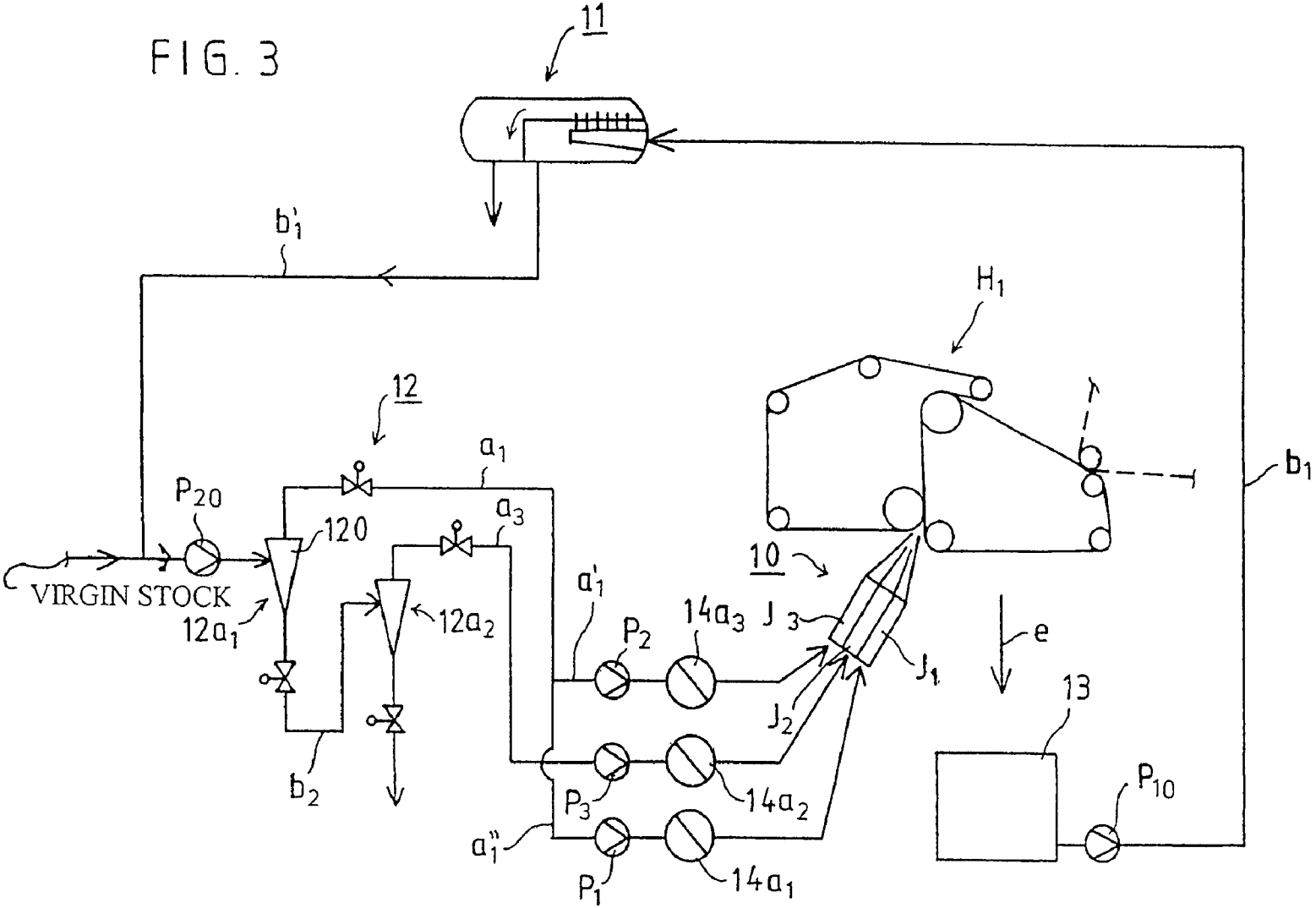
FIG. 3 shows a second advantageous embodiment of the invention, wherein tail water is conducted into a deaeration tank and then virgin stock is admixed with the flow conducted from the deaeration tank, and the flow is conducted further into the centrifugal cleaner installation and through this according to the invention to the multi-layer headbox.

FIG. 3 shows an embodiment of the invention, wherein the tail water is conducted to wire pit 13 along fitting e and the tail water is conducted further from wire pit 13 pumped by pump $P_{10}$ along fitting $b_1$ into deaeration tank 11, from which deaeration tank 11 the tail water is conducted further along fitting $b_1'$ pumped by pump $P_{20}$ to the centrifugal cleaner installation 12. High-consistency pulp, that is, virgin stock, is fed into channel $b_1'$ to the suction side of pump $P_{20}$. From the first step 12$a_1$ of the centrifugal cleaner installation 12 the accept is conducted along fitting $a_1$ into branch fittings $a_1'$, $a_1''$, which include feed pumps $P_1$ and $P_2$, and the pulp is conducted further through power screens 14$a_1$ and 14$a_3$ into bypass manifolds $J_1$ and $J_3$ of the multi-layer headbox 10. From the first step 12$a_1$ of the centrifugal cleaner installation 12 the reject is conducted along fitting $b_2$ to the second step 12$a_2$ of centrifugal cleaner installation 12 as supply, and from the said step the accept is conducted along fitting $a_3$ pumped by pump $P_3$ to power screen 14$a_2$ and further to the central bypass manifold $J_2$ of the multi-layer headbox 10 to form the middle layer of the web.

The invention claimed is:

1. A method for fractionation of pulp in a paper or board machine, comprising the steps of:

conducting virgin stock to a first centrifugal cleaner step of a centrifugal cleaner installation;

conducting an accept comprising a first fraction from the first centrifugal cleaner step into a multi-layer headbox to form a first layer of a web, a reject flow from the first centrifugal cleaner step passing to at least one further centrifugal cleaner step; and conducting a second fraction which comprise an accept from said at least one further centrifugal cleaner step of the centrifugal cleaner installation into the multi-layer headbox to form a second layer of the web.

2. The method of claim 1 wherein a reject flow from the at least one further centrifugal cleaner step is conducted to a third centrifugal cleanser step, an accept flow from the third centrifugal cleaner step being conducted to the multi-layer headbox to form a third layer of the web.

3. The method of claim 1 wherein the accept comprising a first fraction is conducted from the first step of the centrifugal cleaner installation into the multi-layer headbox to form a top or a bottom layer of a three-layer web, and wherein the accept comprising a second fraction is conducted from a second step of the centrifugal cleaner installation into the multi-layer headbox, to form a middle layer of a three-layer web.

4. The method of claim 1 wherein a reject of the first step of the centrifugal cleaner installation is conducted at least partly into a pipe as supply for the at least one further centrifugal cleaner step of the centrifugal cleaner installation.

5. The method of claim 1 wherein a deaeration tank is used, which is formed of several sections, whereby there is a separate supply and discharge pipe to the said deaeration tank for each fraction.

6. The method of claim 1 wherein the multi-layer headbox discharges the layers of the web onto a wire section, and further comprising the step of conducting tail water removed from the wire section into a wire pit, from which the tail water is pumped into a deaeration tank and thence the tail water is conducted forward to a virgin stock mixing point and further into the centrifugal cleaner installation.

7. The method of claim 1 wherein each fraction is finished in a power screen fitted in a pipe in between a deaeration tank and the multi-layer headbox, and an accept of the power screen is conducted as supply into a bypass manifold of the concerned layer in the multi-layer headbox, and a reject of the power screen is conducted back through a wire pit into the centrifugal cleaner installation.

8. An apparatus for fractionation of pulp in a paper or board machine for forming a multi-layer web, the apparatus comprising:

a multi-layer headbox which discharges stock onto a wire, wherein tail water is conducted from the wire;

means for feeding virgin stock to be admixed with the tail water;

a centrifugal cleaner installation having a first centrifugal cleaner which discharges an accept flow and a reject flow, the reject flow passing to a second centrifugal cleaner which discharges a second centrifugal cleaner accept flow and a second centrifugal cleaner reject flow;

a pipe for supplying the virgin stock admixed with the tail water to the first centrifugal cleaner of the centrifugal cleanser installation;

a pipe which supplies the accept from the first centrifugal cleanser of the centrifugal cleanser installation to the multi-layer headbox to form a certain layer of the web; and at least one other pipe from the centrifugal cleaner installation second centrifugal cleaner and/or from some lower centrifugal cleaner/centrifugal cleaners of the centrifugal cleaner installation which conveys the second centrifugal cleaner accept flow or an accept flow from said lower centrifugal cleaner/centrifugal cleaners to the multi-layer headbox to form a second layer or other layers of the multi-layer web.

9. The apparatus of claim 8 wherein the pipe for the accept of the first centrifugal cleaner of the centrifugal cleaner installation is conducted to a deaeration tank, and the pipe leads out of the deaeration tank, along which pipe the accept of the first centrifugal cleaner of the centrifugal cleaner installation is moved, and is branched off into branch pipes, which further join with bypass manifolds of the multi-layer headbox to form top and bottom layers of the web.

10. The apparatus of claim 9 wherein the pipe between the deaeration tank and the multi-layer headbox includes a power screen, which is used for finishing of the pulp fractionation.

11. The apparatus of claim 8 wherein the pipe for the accept of the first centrifugal cleaner of the centrifugal cleaner installation is conducted to a deaeration tank, and the pipe leads out of the deaeration tank to a power screen, which is used for finishing of the pulp fractionation, and thence to the multi-layer headbox, and wherein the tail water is conducted from the wire to a wire pit, and further comprising a return pipe from the power screen for conducting the reject of the power screen into the wire pit.

12. The apparatus of claim 8 further comprising a pipe for the accept from the second centrifugal cleaner of the centrifugal cleaner installation to a deaeration tank and thence further through a pipe into a respective bypass manifold of the multi-layer headbox.

13. The apparatus of claim 8, wherein the pipe for the accept of the first centrifugal cleaner of the centrifugal cleaner installation is conducted to a deaeration tank, and the pipe leads out of the deaeration tank to the multi-layer headbox, wherein the deaeration tank has a plurality of sections, including a section for each pulp fraction and a separate inlet pipe conducted from the centrifugal cleaner installation into each section and a separate outlet pipe from each section, and that from the deaeration tank there is a return pipe for overflow back to a wire pit.

14. The apparatus of claim 8, wherein the tail water is conducted from a tail water tank along a pipe into a deaeration tank, where air is removed from the tail water, and after the deaeration tank the tail water is admixed with virgin stock into a pipe, whereupon the pulp is conducted to the centrifugal cleaner installation, into its first centrifugal cleaner, from which there is a pipe for the accept to the multi-layer headbox to form a certain layer in the multi-layer web, and that from the first centrifugal cleaner the reject is conducted into the second centrifugal cleaner of the centrifugal cleaner installation and that from the second centrifugal cleaner or lower centrifugal cleaners of the centrifugal cleaner installation there is a pipe/pipes for the accept/accepts to the multi-layer headbox to form a second layer or other layers of the multi-layer web.

* * * * *

UNITED STATES PATENT AND TRADEMARK OFFICE

CERTIFICATE OF CORRECTION

PATENT NO. : 7,381,295 B2
APPLICATION NO. : 10/380309
DATED : June 3, 2008
INVENTOR(S) : Kari Kokkonen It is certified that error appears in the above-identified patent and that said Letters Patent is hereby corrected as shown below:

In column 6, line 1 claim 1 of the issued patent, “comprise” should be --comprises--

In column 6, line 57 claim 8 of the issued patent, “cleanser” should be --cleaner--

In column 6, line 59 claim 8 of the issued patent, “cleanser of the centrifugal cleanser” should be --cleaner of the centrifugal cleaner--

Signed and Sealed this

Second Day of September, 2008

JON W. DUDAS
*Director of the United States Patent and Trademark Office*